US009082574B2

(12) United States Patent
Tumback et al.

(10) Patent No.: US 9,082,574 B2
(45) Date of Patent: Jul. 14, 2015

(54) STARTER RELAY FOR A STARTING APPARATUS

(71) Applicant: Robert Bosch GmbH, Stuttgart (DE)

(72) Inventors: Stefan Tumback, Stuttgart (DE); Martin Mezger, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/924,229

(22) Filed: Jun. 21, 2013

(65) Prior Publication Data

US 2013/0342291 A1 Dec. 26, 2013

(30) Foreign Application Priority Data

Jun. 21, 2012 (DE) ..... 10 2012 210 517

(51) Int. Cl.

| | |
|---|---|
| ***H01H 67/02*** | (2006.01) |
| ***H01H 50/00*** | (2006.01) |
| ***F02N 11/08*** | (2006.01) |
| ***F02N 15/06*** | (2006.01) |

(52) U.S. Cl.

CPC ..... *H01H 50/00* (2013.01); *F02N 11/087* (2013.01); *F02N 15/067* (2013.01)

(58) Field of Classification Search

USPC ..... 335/126, 184, 267

See application file for complete search history.

(56) References Cited

U.S. PATENT DOCUMENTS

| | | | | |
|---|---|---|---|---|
| 3,275,964 | A * | 9/1966 | Kumm | 335/259 |
| 3,757,611 | A * | 9/1973 | Buck | 477/100 |
| 5,422,617 | A * | 6/1995 | Brown | 335/267 |
| 5,892,422 | A * | 4/1999 | Montaigu et al. | 335/126 |
| 6,677,844 | B1 * | 1/2004 | Gorospe et al. | 335/220 |
| 6,823,757 | B2 * | 11/2004 | Kobayashi | 74/473.12 |
| 7,965,161 | B2 * | 6/2011 | Roche | 335/229 |
| 7,982,565 | B2 * | 7/2011 | Bradfield et al. | 335/184 |
| 8,289,110 | B2 * | 10/2012 | Niimi et al. | 335/126 |
| 2010/0033066 | A1 | 2/2010 | Murata et al. | |
| 2010/0251852 | A1 | 10/2010 | Murata et al. | |
| 2011/0095852 | A1 * | 4/2011 | Niimi et al. | 335/184 |

FOREIGN PATENT DOCUMENTS

| | | |
|---|---|---|
| DE | 102005021227 | 11/2006 |
| DE | 102009027117 | 12/2010 |

* cited by examiner

*Primary Examiner* — Alexander Talpalatski

(74) *Attorney, Agent, or Firm* — Michael Best & Friedrich LLP

(57) ABSTRACT

A starter relay for a starting apparatus for an internal combustion engine has a reciprocating armature and a pull-in winding, to which current can be applied, and also a switch-on device for an electric starter motor. The switch-on device is operated by means of a switching element which is adjusted by an additional winding.

15 Claims, 3 Drawing Sheets

STARTER RELAY FOR A STARTING APPARATUS

BACKGROUND OF THE INVENTION

The invention relates to an electromagnetic starter relay for a starting apparatus for an internal combustion engine.

DE 10 2005 021 227 A1 discloses a starter apparatus for an internal combustion engine which has a starter pinion which can be adjusted, by means of an electromagnetic starter relay, between an axially retracted inoperative position and an extended engagement position in which the starter pinion engages in a ring gear of the internal combustion engine. The starter relay is operated for starting purposes, in this case the actuating movement of the reciprocating armature of the starter relay is converted into the axial actuating movement of the starter pinion by means of a lever.

A switch-on device for starting an electric drive motor is integrated in the starter relay, the starter pinion being driven in a rotational manner in the engaged state by means of said electric drive motor. When the reciprocating armature is at maximum deflection, a contact bridge is moved against two mating contacts in the switch-on device, with the result that an electric circuit for starting the electric starter motor is closed.

DE 10 2009 027 117 A1 describes a starting apparatus having an electromagnetic starter relay which has, in one housing, two separate relay windings which are arranged axially one behind the other. The first relay winding has the function of a pull-in winding and adjusts a reciprocating armature which is coupled to the starter pinion by means of an engagement lever. The second relay winding serves as a switching winding and is associated with a switch-on device by means of which the electric circuit of the starter motor is switched on and switched off. To this end, the switch-on winding operates a switching armature which, in the adjusted state, pushes a contact plate against two mating contacts in order to close the electric circuit of the starter motor. The reciprocating armature and the switching armature are separated from one another by a core part which can be electromagnetically excited, against which a reciprocating armature return spring is supported and which forms an electromagnetic electric circuit with the reciprocating armature and the housing of the starter relay.

SUMMARY OF THE INVENTION

The invention is based on the object of allowing problem-free engagement of the starter pinion in the ring gear of an internal combustion engine under different operating conditions using simple design measures.

The electromagnetic starter relay is used in starting apparatuses for internal combustion engines in order to adjust a starter pinion between an inoperative position and an engagement position with a ring gear of the internal combustion engine. The starting apparatus also has an electric starter motor which can be switched on by means of a switching movement of the starter relay. To this end, a switch-on device, which can be operated by means of the starter relay, is integrated in the starter relay. The starter motor drives the starter pinion in a rotational manner in the engaged state, with the result that the ring gear is also driven and the internal combustion engine is started.

The actuating movement of the starter pinion between the inoperative position and the engagement position with the ring gear of the internal combustion engine is preferably an axial movement along the longitudinal axis of the starter pinion. However, in principle, pivoting movements can also be considered to be an actuating movement of the starter pinion.

The switch-on device closes an electric circuit by means of which current is supplied to the starter motor. The switch-on device has a switching element which, when the starter relay is operated, is moved to a switching position in which the switching element is in contact with two mating contacts of the electric circuit in which the starter motor is situated.

The starter relay has a first relay winding which forms the pull-in winding, the reciprocating armature of the starter relay being adjusted and the starter pinion being adjusted between the inoperative position and the engagement position with the ring gear of the internal combustion engine when current is applied to said pull-in winding. Furthermore, the starter relay is provided with a second relay winding which forms a switching winding which acts on the switching element in order to switch on the switch-on device. The starter relay is therefore equipped with two different windings, it being possible for current to be applied to each of said windings, wherein the pull-in winding preferably solely operates the reciprocating armature, and the switching winding preferably solely adjusts the switching element of the switch-on device. Both actuating movements, that is to say both of the reciprocating armature and of the switching element, are axial actuating movements. Coupled movements may also come into consideration, with the result that, for example, the switching element of the switch-on device can also be adjusted when current is applied to the pull-in winding, but without the switch-on position being reached.

In a further advantageous embodiment, the mutual influence of the magnetic circuits is so great that the armatures can each be pulled in independently of one another and that, secondly, the application of current to one of the two windings is sufficient to hold both armatures in their operating position.

Current is preferably applied to the pull-in winding and to the switching winding independently. However, in principle, it is also possible to control the application of current to the switch-on winding by means of the actuating movement of the reciprocating armature, with the result that current is applied to the switching winding when a defined position of the reciprocating armature is reached.

The switching element of the switch-on device is designed as an axially adjustable switching armature. The switching armature is a component which is formed separately from the reciprocating armature and which is preferably arranged coaxially to the reciprocating armature and is adjustable. The adjusting movement of the reciprocating armature and the switching armature when current is applied to the pull-in winding and/or the switching winding advantageously takes place in the same direction. In the case of an expedient arrangement of the pull-in winding and the switching winding axially one behind the other, the reciprocating armature and the switching armature are preferably situated axially at a distance from one another in the starting state, with the result that, when the reciprocating armature is operated in order to extend the starter pinion, the pinion makes contact with the ring gear before the reciprocating armature makes contact with the switching armature which is still in the starting position.

In the starter relay according to the invention, the switching armature, which is composed of a magnetically permeable material, forms the magnet core or the core plate for the reciprocating armature, with the result that the reciprocating armature and the switching armature are situated in a common magnetic electric circuit. Overall, the magnetic electric circuit, which is responsible for the adjusting movement of the starter pinion, comprises the conductive housing of the starter pinion, the reciprocating armature and the switching armature and possibly a magnetically permeable web between the two windings. Since an additional magnet core for forming the magnetic return path is not required, the starter relay can have a very compact design in spite of having two relay windings.

The design with structural independence of the switching armature and the reciprocating armature and the ability to apply current to the pull-in winding and the switching winding independently allows for versatile applications together with a compact design of the electromagnetic starter relay. In order to start the internal combustion engine, the two windings are switched in a suitable time sequence. If, for example, the rotation speed of the ring gear is below a limit value, current is advantageously initially applied to the pull-in winding, with the result that the reciprocating armature is operated and the starter pinion is adjusted from the starting position to the engagement position. Subsequently, current is additionally applied to the switching winding, with the result that the switching armature is moved to the switching position and the electric circuit of the electric starter motor is closed and the starter motor begins to rotate. Once the internal combustion engine has started, the application of current to the pull-in winding can be switched off, in response to which the starter pinion is moved back from the engagement position to the inoperative position by spring force and/or by recoil which is caused by the ring gear.

If, in contrast, the rotation speed of the ring gear is above the limit value, current can be applied to the switching winding even before contact is made with the ring gear of the internal combustion engine, in order to increase the rotation speed of the starter pinion and to reduce the rotation speed difference between the starter pinion and the ring gear. Bonanza effects in the drive train of the starting apparatus are reduced as a result.

Force is advantageously applied to both the reciprocating armature and the switching armature by means of an armature return spring in their starting position in each case. In order to deflect the reciprocating armature or the switching armature, current has to be applied to the respective relay winding and the armature in question has to be adjusted against the force of its associated armature return spring.

The reciprocating armature return spring, which applies force to the lifting armature in its starting position, can be supported against the switching armature. This design has the advantage that it can be realized in a structurally simple manner. In this case, the return force of the switching armature return spring has to be such that it is greater in the inoperative position than that of the reciprocating armature return spring in its inoperative position.

The reciprocating armature return spring, on that side which is averted from the switching armature, can also be supported against the housing of the starter relay or against a component which is connected to the housing. This ensures that the reciprocating armature return spring does not act on the switching element of the switch-on device and the forces on the switching element are independent of the movement of the reciprocating armature.

When the switching element is designed as a switching armature, it can be designed in the form of a sleeve which accommodates a supporting part for the reciprocating armature return spring, wherein the supporting part is supported against the housing or a switch cover of the switch-on device, which switch cover is fixedly connected to the housing. The supporting part is arranged to be fixed to the housing and is not involved in the movement of the reciprocating armature or of the switching element. The supporting part accommodates the reciprocating armature return spring on that side which is averted from the reciprocating armature.

The pull-in winding and the switching winding are expediently arranged axially one behind the other in the housing of the starter relay. In order to separate the magnetic field of the pull-in winding and the switching winding, the two windings are advantageously arranged axially at a distance from one another, wherein it may be expedient for a separating web, which is advantageously composed of a magnetically permeable material, to project into the gap between the pull-in winding and the switching winding. It is also possible for the separating web to be integrally formed with the housing and to project radially inward from the housing outer wall and run around the inner wall of the housing in the form of a ring. Since the separating web conducts magnetic flux, the magnetic circuits of the windings can be separated from one another.

It may further be expedient for the engagement winding with the separating web to axially at least partially engage over the switching armature in its starting position. This ensures that the switching armature, in the starting position, that is to say with current not applied to the switching winding, is situated in an electromagnetic circuit together with the reciprocating armature.

BRIEF DESCRIPTION OF THE DRAWINGS

Further advantages and expedient embodiments can be found in the further Claims, in the description of the figures and in the drawings, in which:

In the figures, identical components are provided with identical reference symbols.

DETAILED DESCRIPTION

Figure 1:
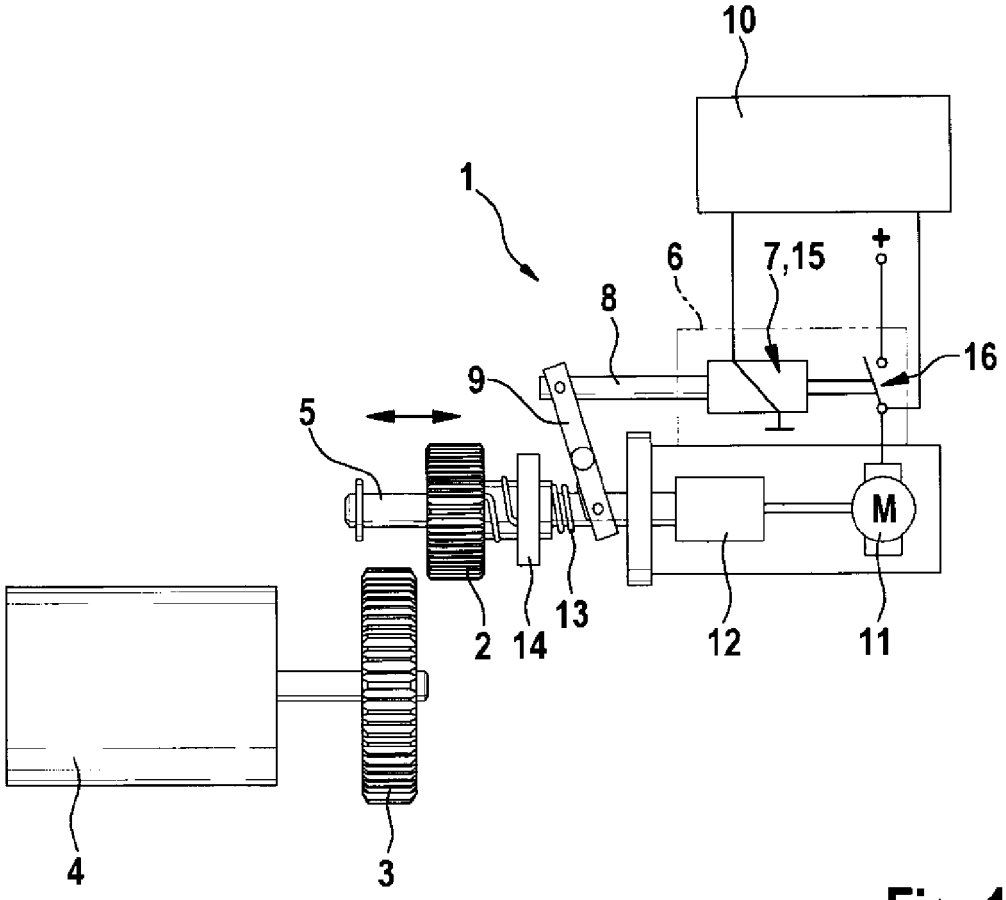
FIG. 1 shows a starting apparatus for an internal combustion engine having a starter pinion which can be axially adjusted by means of a starter relay and can be driven in rotation by means of an electric starter motor, wherein the electric starter motor is switched on by means of a switch-on device in the starter relay.

The starting apparatus 1 (illustrated in FIG. 1) for an internal combustion engine has a starter pinion 2 which, in order to start the internal combustion engine 4, engages with a ring gear 3 of the internal combustion engine. The starter pinion 2 is axially displaceably mounted on a shaft 5, as indicated by a double-headed arrow, wherein the starter pinion 2 is coupled to the shaft 5 in a rotationally fixed manner. The starter pinion 2 is adjusted between a retracted inoperative position and an extended engagement position with the ring gear 3 of the internal combustion engine 4 by means of a starter relay 6 which is of electromagnetic design and comprises two relay windings 7, 15, to which current can be applied, and a reciprocating armature 8 which, when the current is applied to the first relay winding 7 which has the function of a pull-in winding, is axially drawn into said winding. The reciprocating armature 8 operates an engagement lever 9, which acts on an engagement spring 13 which is seated on a driver 14 of a roller freewheeling mechanism. The starter pinion 2 is coupled, on the output drive side, to the driver 14, with the result that the axial advancing movement of the driver 14 is converted into the desired axial actuating movement of the starter pinion 2 between the inoperative position and the engagement position.

The rotational drive movement on the shaft 5 or the starter pinion 2 is generated with the aid of an electric starter motor 11 which is coupled to the shaft 5 by means of a gear mechanism 12, for example a planetary gear mechanism. When the electric starter motor 11 is operated, the shaft 5 and therefore the starter pinion 2 are made to rotate.

The starter motor 11 is switched on by means of a switch-on device 16 which is integrated in the starter relay 6. The electric circuit is closed in the switch-on device 16 by means of a switching element which is designed as a switching armature and is moved when current is applied to the second relay winding 15 which has the function of a switching winding. When the electric circuit is closed, the starter motor 11 is made to move and the shaft 5 and the starter pinion 2 are driven in rotation.

The starting apparatus 1 has an associated open-loop or closed-loop control device 10 which controls the functions of the starter relay 6 and of the starter motor 11. It is possible, in particular, for current to be applied to the pull-in winding 7 and to the switching winding 15 independently of one another.

Figure 2:
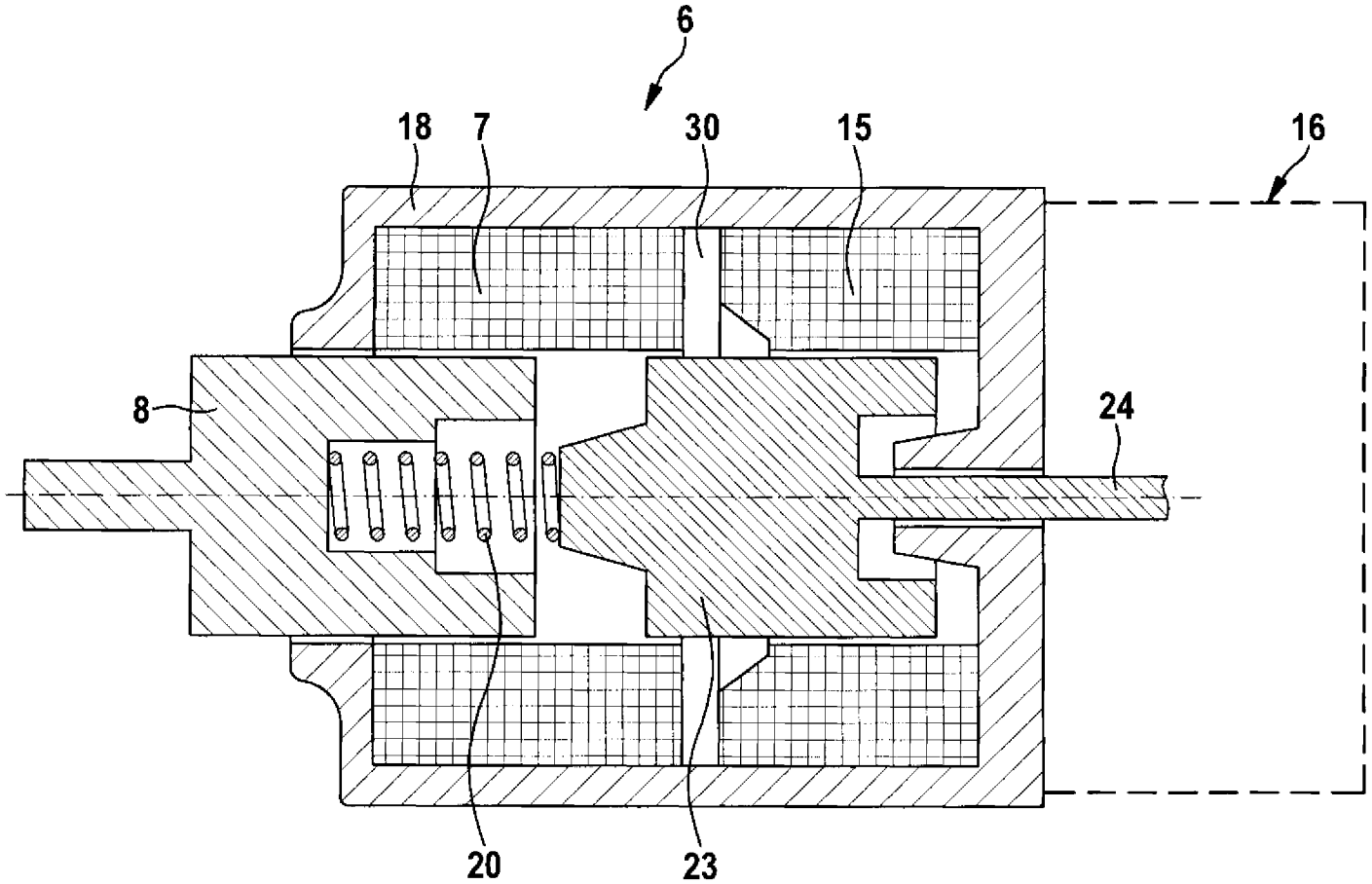
FIG. 2 shows a section through a starter relay having an integrated switch-on device.

FIG. 2 shows a longitudinal section through a starter relay 6. The starter relay 6 has two relay windings 7, 15 which are arranged axially one behind the other in the housing 18 of the starter relay, wherein there is an air gap 30 between the relay windings 7, 15. The first relay winding 7 serves as a pull-in winding for axially adjusting the reciprocating armature 8 which causes the actuating movement of the starter pinion. The second relay winding 15 is associated with the switch-on device 16 for starting the electric starter motor and, when current is applied to it, adjusts the switching armature 23 to which force is advantageously applied by a switching armature return spring to its starting position. When current is applied to the switching winding 15, the switching armature 23 is moved against the force of the switching armature return spring, as a result of which the electric circuit is closed.

The reciprocating armature return spring 20, which applies force to the reciprocating armature 8 in its starting position, is supported against the end face of the switching armature 23. The reciprocating armature 8 forms an electromagnetic circuit with the switching armature 23 and a portion of the housing 18.

Figure 3:
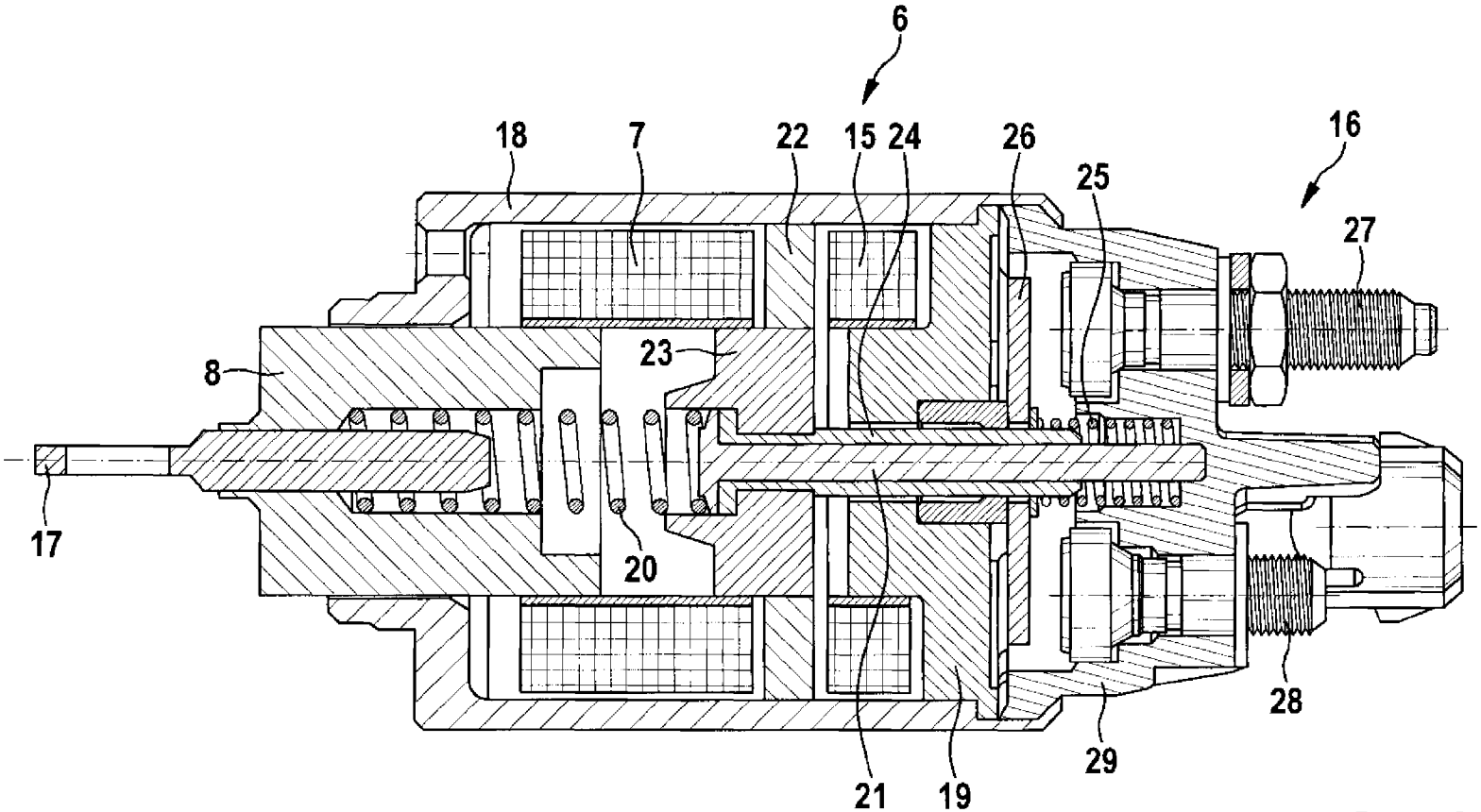
FIG. 3 shows a section through a further embodiment of the starter relay having the integrated switch-on device.

As shown in the sectional illustration according to FIG. 3 through the starter relay 6, the reciprocating armature 8 is the support for a tappet 17, the engagement lever 9 (FIG. 1) acting on the free end of said tappet. The reciprocating armature 8 is held in an axially adjustable manner in the housing 18 of the starter relay 6, and is pulled into the housing in the direction of a magnet core 19 when current is applied to the pull-in winding 7. Force is axially applied to the reciprocating armature 8 by a reciprocating armature return spring 20 in the direction of its starting position. The reciprocating armature return spring 20 is supported, on the side of a switching armature 23, against a supporting part 21 which is held in a manner fixed to the housing and is supported, in particular, against a switch cover 29 of the switch-on device 16.

The pull-in winding 7 and the switching winding 15 are arranged axially one behind the other against the inner wall of the housing 18 and are separated by a separating web 22 which projects into the axial gaps between the windings 7, 15. The separating web 22 is preferably composed of a magnetically permeable material and is designed as a ring which runs around the inner wall of the housing 18. In the starting state, the engagement winding 7 axially partially engages over the switching winding 15.

The switch-on device 16 for switching on and switching off the electric starter motor is integrated in the starter relay 6 or arranged on the starter relay 6 and is fixedly connected to the housing 18. The switch-on device 16 has a switching armature 23 which, when current is applied to the associated switching winding 15, is adjusted from the starting position axially in the direction of the magnet core 19 which is arranged axially adjacent to the switch-on device 16 in the housing 18. A switching sleeve 24 is fixedly connected to the switching armature 23, said switching sleeve, like the switching armature 23, being mounted coaxially to the reciprocating armature 8 and being adjustable along the longitudinal axis of the starter relay 6. The switching sleeve 24 accommodates the pin-like supporting part 21 against which the reciprocating armature return spring 20 is supported, wherein the supporting part 21 is held fixed to the housing and the switching sleeve 24 can be axially adjusted against the force of a switching armature return spring 25 when current is applied to the switching winding 15. During an adjusting movement of the switching armature 23 when current is applied to the switching winding 15, a contact bridge 26, which is fixedly connected to the switching sleeve 24, comes into electrical contact with two mating contacts 27, 28 which are situated in the electric circuit of the electric starter motor, as a result of which the electric circuit is closed and the electric starter motor is started.

In principle, current is applied to the pull-in winding 7 and the switching winding 15 independently of one another. This allows different procedures which can be carried out depending on the current operating state. In particular, engagement processes in a ring gear of the internal combustion engine which is still rotating are possible, for example in the event of restarting shortly after the internal combustion engine is switched off when the starter pinion has to engage with the ring gear as said ring gear is coming to a stop.

What is claimed is:

1. An electromagnetic starter relay for a starting apparatus for an internal combustion engine, comprising:

a reciprocating armature (8);

a pull-in winding (7), to which current can be applied;

a switch-on device (16) for switching on an electric starter motor (11); and an additional winding, as a switching winding (15) to which current can be applied and which acts on an axially adjustable switching armature (23) of the switch-on device (16), wherein the switching armature (23) forms a core plate for the reciprocating armature (8), and the reciprocating armature (8) and the switching armature (23) are positioned in a common electromagnetic circuit, and further wherein the reciprocating armature (8) is acted on by a reciprocating armature return spring (20) in a starting position of said reciprocating armature, and the reciprocating armature return spring (20) lc supportcd against acts on the axially adjustable switching armature (23).

2. The starter relay according to claim 1, characterized in that the reciprocating armature return spring (20), on a side which is averted from the reciprocating armature (8), is supported against one of a housing (18) of the starter relay (6) and a component which is connected to the housing (18).

3. An electromagnetic starter relay for a starting apparatus for an internal combustion engine, comprising:

a reciprocating armature (8);

a pull-in winding (7), to which current can be applied;

a switch-on device (16) for switching on an electric starter motor (11); and an additional winding, as a switching winding (15) to which current can be applied and which acts on an axially adjustable switching armature (23) of the switch-on device (16), characterized in that the switching armature (23) forms a core plate for the reciprocating armature (8), and the reciprocating armature (8) and the switching armature (23) are positioned in a common electromagnetic circuit, and characterized in that the switching armature (23) is a sleeve and accommodates a supporting part (21) for a reciprocating armature return spring (20).

4. The starter relay according to claim 3, characterized in that the supporting part (21), on a side which is averted from the reciprocating armature (8), is supported against a switch cover (29) of the switch-on device (16).

5. The starter relay according to claim 1, characterized in that the pull-in winding (7) axially at least partially engages over the switching armature (23) in a starting position of said switching armature.

6. The starter relay according to claim 1, characterized in that the pull-in winding (7) and the switching winding (15) are arranged axially one behind the other in a housing (18) of the starter relay (6).

7. The starter relay according to claim 6, characterized in that a separating web (22) is arranged between the pull-in winding (7) and the switching winding (15).

8. The starter relay according to claim 7, characterized in that the separating web (22) is produced from a magnetically permeable material.

9. The starter relay according to claim 1, characterized in that current can be applied to the pull-in winding (7) and the switching winding (15) independently of one another.

10. The starter relay according to claim 1, characterized in that a switching armature return spring (25) applies force to the switching armature (23) in a starting position in which the switch-on device (16) is switched off.

11. A starter apparatus for an internal combustion engine having a starter relay (6) according to claim 1.

12. A method for operating a starting apparatus for an internal combustion engine, the starting apparatus having a starter relay including a reciprocating armature (8), a pull-in winding (7), to which current can be applied, a switch-on device (16) for switching on an electric starter motor (11), and an additional winding, as a switching winding (15) to which current can be applied and which acts on an axially adjustable switching armature (23) of the switch-on device (16), wherein the switching armature (23) forms a core plate for the reciprocating armature (8), and the reciprocating armature (8) and the switching armature (23) are positioned in a common electromagnetic circuit, and further wherein the reciprocating armature (8) is acted on by a reciprocating armature return spring (20) in a starting position of said reciprocating armature, and the reciprocating armature return spring (20) is supported against the axially adjustable switching armature (23), wherein, in the method, in the case of an engagement process in a ring gear (3) of the internal combustion engine (4), current is initially applied only to the pull-in winding (7) and a reciprocating armature (8) contacts a movable switching armature (23) and, after engagement, current is applied both to the pull-in winding (7) and to the switching winding (15) if the rotation speed of the ring gear is below a limit value, and current is applied to the switching winding (15) even before the starter pinion makes contact with the ring gear of the internal combustion engine if the rotation speed of the ring gear exceeds a limit value.

13. The starter relay according to claim 1, characterized in that the pull-in winding (7) and the switching winding (15) are arranged axially directly one behind the other in a housing (18) of the starter relay (6).

14. The starter relay according to claim 1, wherein the pull-in winding (7) and the switching winding (15) are arranged axially one behind the other in a housing (18) of the starter relay (6), the housing (18) having an inner wall, wherein a separating web (22) is configured as a ring with a through-hole, the separating web (22) surrounding the switching armature (23) and arranged between the pull-in winding (7) and the switching winding (15), whereby the switching armature (23) is configured to pass through the through-hole.

15. The starter relay according to claim 1, wherein the reciprocating armature (8) and the switching armature (23) are configured for direct contact in response to current applied to the pull-in winding (7).

* * * * *